United States Patent [19]

Morris

[11] 4,110,712

[45] Aug. 29, 1978

[54] MICROSTRIP CIRCUIT HAVING COPLANAR WAVEGUIDE PORT

[75] Inventor: Ronald George Morris, Worcester, England

[73] Assignee: The Secretary of State for Defence in Her Britannic Majesty's Government of the United Kingdom of Great Britain and Northern Ireland, London, England

[21] Appl. No.: 798,210

[22] Filed: May 18, 1977

Related U.S. Application Data

[63] Continuation-in-part of Ser. No. 682,861, May 3, 1976, abandoned.

[30] Foreign Application Priority Data

May 14, 1975 [GB] United Kingdom ..... 20470/75

[51] Int. Cl.[2] ..... H01P 3/08

[52] U.S. Cl. ..... 333/33; 333/84 M

[58] Field of Search ..... 333/33, 84 R, 84 M

[56] References Cited

U.S. PATENT DOCUMENTS

| | | | |
|---|---|---|---|
| 3,546,637 | 12/1970 | Wen | 333/84 M X |
| 3,721,919 | 3/1973 | Grace | 333/84 M X |
| 3,835,420 | 9/1974 | Orime et al. | 333/84 M X |
| 3,908,185 | 9/1975 | Martin | 333/84 M X |

FOREIGN PATENT DOCUMENTS

| | | | |
|---|---|---|---|
| 765,465 | 1/1957 | United Kingdom | 333/84 M |

*Primary Examiner*—Paul L. Gensler

*Attorney, Agent, or Firm*—Pollock, Vande Sande and Priddy

[57] ABSTRACT

A microwave integrated circuit component comprises a dielectric substrate layer having an electrically conducting circuit on one face and an electrically conducting ground electrode on the other face. Two electrically conducting strips extend from the ground electrode round the edge of the substrate to lie alongside a part of the circuit. The circuit is contained within a box which carries at least one connector in its side walls for connecting the integrated circuit with external co-axial lines.

5 Claims, 3 Drawing Figures

MICROSTRIP CIRCUIT HAVING COPLANAR WAVEGUIDE PORT

This application is a continuation-in-part of Morris U.S. application Ser. No. 682,861, filed May 3, 1976, for "Microwave Integrated Circuits", now abandoned.

This invention relates to microwave integrated circuits, particularly microstrip circuits.

Microstrip circuits are one type of microwave integrated circuits (M.I.C.) used in many modern radar systems. Other types include stripline, slot line, coplanar waveguide, and suspended stripline. Their advantage over say waveguide is their small size and lower cost. Various microwave circuit elements, e.g. mixing, dividing, coupling, etc. may be produced in microwave integrated circuit form.

A microstrip circuit consists of a circuit pattern and a ground plane separated by a dielectric substrate and is usually enclosed within a tightly fitting box. The ground plane of the circuit is pressed firmly against the base of the box to make a good connection between the ground plane of the circuit and co-axial lines attached to the box. The central connector in the coaxial line is spring loaded into contact with the circuit pattern. To reduce unwanted reflection and losses tolerances on the box, circuit, and air line connector are all small, thereby increasing cost and complexity.

One problem that occurs when using microstrip circuits is losses at junctions between the microstrip circuit itself and co-axial air lines which feed signal to and from the microstrip circuits. Such reflections and losses are undesirably high at GHz frequencies even when the components are made and assembled with great care.

According to this invention a microstrip integrated circuit component comprises a closed box, a microstrip circuit mounted within the box and at least one co-axial connector having a central electrode extending through a hole in the side wall of the box for making electrical connection to the circuit from the exterior of the box, the microstrip circuit comprising a dielectric substrate layer, an electrically conducting circuit on one surface of the substrate with at least one port section extending to the substrate edge, an electrically conducting ground plane electrode on the other surface of the substrate and two electrically conducting strips extending integrally from the ground plane onto said one surface at positions on either side of the port section, with the minimum distance between the strips being substantially equal to the hole diameter.

The strips may extend from the port section to form part of a co-planar waveguide.

The invention will be described, by way of example only, with reference to the accompanying drawings of which:

Figure 1:
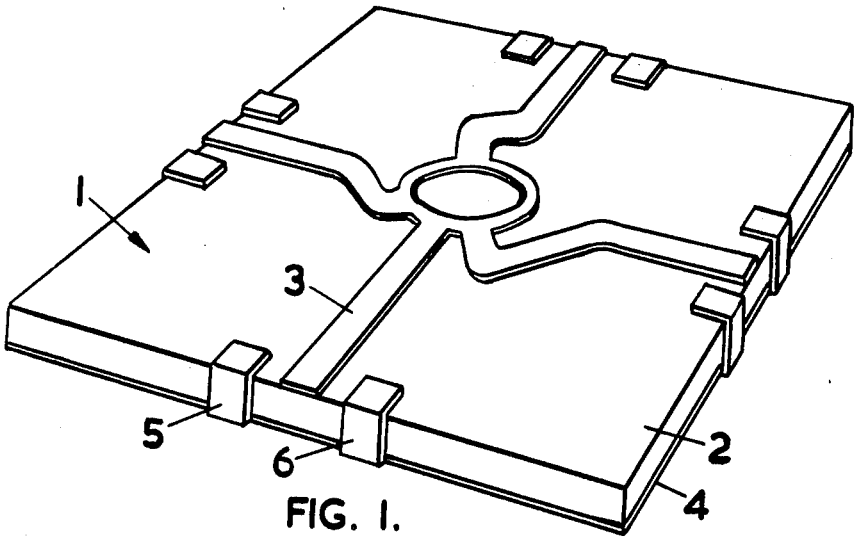
FIG. 1 shows a microstrip circuit.

The microstrip circuit shown in FIG. 1 is a so-called hybrid ring circuit 1 having four ports and comprises a 99.5% alumina dielectric substrate 2 typically 0.63mm thick and about 2.54cm square. On one surface of the substrate 2 a hybrid ring circuit pattern 3 is formed by a conventional thick film printing technique. The circuit pattern is of gold material having a thickness of 12 to 15 μm typically 14 μm. On the other surface of the substrate 2 is a ground electrode 4 formed by a layer of gold deposited as a 14 μm thick layer by printing. The ground electrode 4 is continued round the substrate edges in strips 5, 6, which extend from these edges for a short distance alongside the circuit 3 with a thickness of 12 to 15 μm typically 14 μm. The area around the substrate edges by the ground electrode strips 5, 6 and circuit 3 resembles a coplanar waveguide.

The circuit pattern 3 and ground electrode 4 may be formed by so-called thick film silk screen printing techniques. Such techniques involve pressing gold ink (e.g. Engelhard 9177 or 2888, an ink available from Engelhard Sales Ltd., Valley Road, Cinderford, Gloucestershire, England) through a mask carried on a stainless steel mesh onto the substrate 2. These masks are formed by coating light sensitive emulsion onto a tightly stretched stainless steel mesh (which replaces silk mesh used previously). The emulsion is then exposed to light through a mask, and then processed to open up spaces in the emulsion through which ink can be pressed. To provide electrical continuity between the ground electrode 4 and strips 5, 6, gold ink is hand painted on the substrate edges. Alternatively the gold ink may be placed on the edges from a roller carrying a raised printing pattern.

After depositing ink onto the substrate the inked substrate is heated in an oven to remove ink solvents and to bind the ink pattern to the substrate.

As an alternative to thick film circuits so called thin film techniques may be used. One example of these techniques involves sputter coating of a 200° A thick chromium or nichrome layer onto the substrate followed by evaporation of a thin (typically 0.5 to 1 μm) electrode layer. This electrode layer is then shaped by selective etching using standard photolithographic processes.

Figure 2:
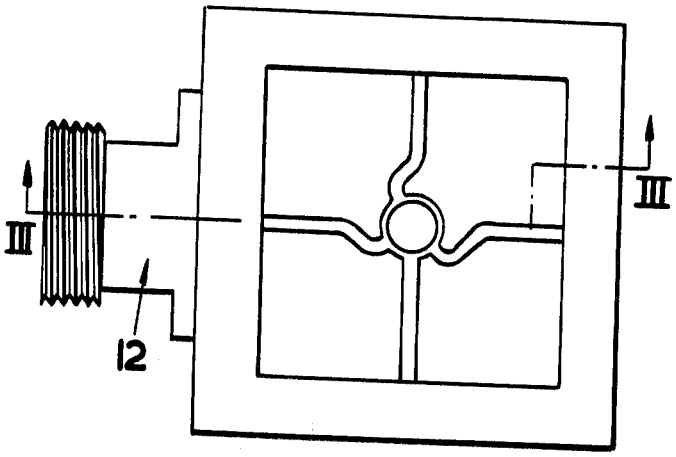
FIG. 2 shows a microstrip circuit arranged within a box.
Figure 3:
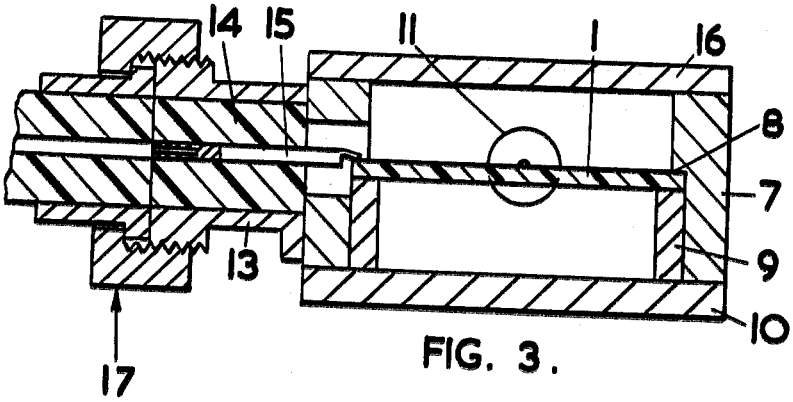
FIG. 3 shows a section on the line III — III of FIG. 2.

FIGS. 2, 3 show the microstrip of FIG. 1 in a closely fitting box 7. The inner walls of the box are stepped as at 8 to retain the circuit 1 in position by cooperation with a spacer 9 and a lid 10 which is screwed to the box 7. The spacer 9 is dimensioned so that the circuit 1 is held firmly against the step 8 so that the ground strips 5, 6 press tightly against the step 8. Holes 11 are formed in the sides of box 7 and standard co-axial line launch connectors 12 are secured to the walls in alignment with these holes 11. Standard co-axial lines 17 screw into the connectors 12. These connectors 12 have a metal body 13 containing a dielectric material 14 which supports a central electrode 15. This central electrode 15 passes through the holes 11 and contacts the circuit pattern 3. Prior to installation of the circuit 1 the end of each central electrode 15 (which is beak shaped) is adjusted by moving the connectors 12 so that insertion of the circuit 1 into box 7 will bend the central electrode 15 slightly and thus maintain its contact with the circuit pattern 3. A lid 16 (not shown in FIG. 2) finally encloses the microstrip circuit 1 to shield it from stray signals and if necessary shield it from ingress of moisture in which case the box is hermetically sealed.

The diameter of the holes 11 is chosen so that the characteristic impedance of the hole 11 and central electrode 15 matches the characteristic impedance of the co-axial line 17, the launch connector 12, and microstrip circuit 1 thereby avoiding reflecting discontinuities. For example, with the circuit 1 described which has a 50 ohm characteristic impedance with standard 50 ohm co-axial line 17 and connectors 12 having a central electrode 15 of 1.28mm diameter, the holes 11 are about 3mm diameter. For a 75 ohm construction the holes 11 are about 4.5mm diameter. The ground strip electrodes 5, 6 are spaced so that their minimum distance apart is substantially the same as the diameter of the holes 11 (e.g. 3mm for a 50 ohm construction) with the adjacent circuit pattern 3 arranged centrally. The dimension of the strips 5, 6 measured along the circuit pattern 3 is typically 1mm while the dimension parallel to the substrate edge is arranged to suit manufacturing convenience e.g. 3mm. The thickness of the strips 5, 6 is conveniently arranged to be the same as that of the circuit pattern 3. For the thick film printing techniques described above the strips 5, 6 are 12 to 15 μm thick but this can be increased provided the circuit 1 still fits tightly into the box 7.

The provision of ground electrode strips 5, 6 adjacent the circuit layer 3 has been found to reduce launch and recovery losses at the microstrip/co-axial line interface. In a typical case using this invention the voltage standing wave ratio (V.S.W.R.) at a launching point was less than 1.10 up to about 12GHz; without use of this invention a typical V.S.W.R. was 1.14 tested up to 10GHz.

What I claim is:

1. A microstrip component comprising:

a closed box, a microstrip circuit mounted entirely within the box, at least one electrical coaxial connector having a central electrode which extends through a hole in a side wall of the box for making electrical connection to the circuit from the exterior of the box, the microstrip circuit comprising:

a dielectric substrate, an electrically conducting circuit including at least one port section which extends on one surface of said substrate to an edge of said substrate for connection with said central electrode, an electrically conducting ground plane electrode on the other surface of said substrate, and two thin electrically conducting strips extending integrally from said ground plane electrode around an edge of said substrate and onto said one surface at positions either side of, but electrically isolated from said port section with the minimum distance between said strips being substantially equal to the diameter of said hole, the dimensions of the connector, central electrode, hole, and microstrip circuit being arranged to provide substantially the same characteristic impedance throughout with minimal reflecting discontinuities.

2. A microstrip component according to claim 1 wherein the box includes an interior step portion, said microstrip circuit being mounted with one face in engagement with said step portion, a spacer element within said box in engagement with the other face of said microstrip circuit, and means for removably retaining said spacer element in place.

3. A component according to claim 2 wherein the circuit is formed by a thick film printing technique.

4. A component according to claim 2 wherein the circuit, the ground plane electrode, and the two electrically conducting strips are of a gold based material.

5. A component according to claim 4 wherein the gold based material is less than 16 μm thick.

* * * * *